US010994324B2

(12) United States Patent
Huber

(10) Patent No.: US 10,994,324 B2
(45) Date of Patent: May 4, 2021

(54) DEVICE FOR APPLYING AN APPLIED FORCE TO A CONNECTION ELEMENT

(71) Applicant: BALTEC MASCHINENBAU AG, Pfäffikon (CH)

(72) Inventor: Klaus Huber, Ebmatingen (CH)

(73) Assignee: BALTEC AG, Pfäffikon (CH)

( * ) Notice: Subject to any disclaimer, the term of this patent is extended or adjusted under 35 U.S.C. 154(b) by 151 days.

(21) Appl. No.: 16/084,278

(22) PCT Filed: Mar. 14, 2017

(86) PCT No.: PCT/EP2017/055970
§ 371 (c)(1),
(2) Date: Sep. 12, 2018

(87) PCT Pub. No.: WO2017/157926
PCT Pub. Date: Sep. 21, 2017

(65) Prior Publication Data

US 2019/0076912 A1 Mar. 14, 2019

(30) Foreign Application Priority Data

Mar. 18, 2016 (CH) ..... 00382/16

(51) Int. Cl.
*B21J 15/12* (2006.01)
*B21J 15/28* (2006.01)
(Continued)

(52) U.S. Cl.
CPC ..... *B21J 15/12* (2013.01); *B21J 9/025* (2013.01); *B21J 15/28* (2013.01)

(58) Field of Classification Search
CPC ... B21J 15/12; B21J 15/15; B21J 15/28; B21J 9/025; H02K 7/06
(Continued)

(56) References Cited

U.S. PATENT DOCUMENTS 6,089,062 A * 7/2000 Zemp ..... B21J 9/20 72/17.2
10,010,928 B2 * 7/2018 Zinn ..... B23K 20/1265
(Continued)

FOREIGN PATENT DOCUMENTS

CN 102780311 A * 11/2012
DE 20 2013 000 092 U1 4/2014
(Continued)

OTHER PUBLICATIONS

English translate (JPH0780586A), retrieved date Apr. 27, 2020.*
(Continued)

*Primary Examiner* — Adam J Eiseman
*Assistant Examiner* — Mohammed S. Alawadi
(74) *Attorney, Agent, or Firm* — Pearne & Gordon LLP

(57) ABSTRACT

The application relates to a device for applying an applied force to a connection element such that the connection element is plastically deformed by the application of force. The device comprises a movably mounted head part with a machining head which is designed to contact the connection element; a drive which is designed to drive a translation of the head part in the longitudinal axis thereof; a second drive which is designed to drive a rotation of the machining head about a longitudinal axis; and a housing for receiving the first drive, the second drive, and the head part. The first drive and the second drive are electrically driven and are arranged coaxially. The application further relates to a method for operating a device according to the application and to the use of a device according to the application as an electric riveting machine.

14 Claims, 5 Drawing Sheets

(51) Int. Cl.
*B21J 9/02* (2006.01)
*H02K 7/06* (2006.01)

(58) Field of Classification Search
USPC ..... 72/67
See application file for complete search history.

(56) References Cited

U.S. PATENT DOCUMENTS

| | | | | |
|---|---|---|---|---|
| 2007/0290556 | A1* | 12/2007 | Hochhalter | H02K 11/24 310/12.14 |
| 2013/0249464 | A1* | 9/2013 | Knox | H02K 7/06 318/625 |
| 2016/0114383 | A1* | 4/2016 | Honsel | B21J 15/26 29/525.07 |

FOREIGN PATENT DOCUMENTS

| | | | | |
|---|---|---|---|---|
| EP | 0820823 | A1 * | 1/1998 | B21J 15/285 |
| FR | 2 660 219 | A1 | 10/1991 | |
| JP | H0780586 | A * | 3/1995 | B21J 15/027 |
| WO | 2005/007319 | A1 | 1/2005 | |

OTHER PUBLICATIONS

English translate (CN102780311A), retrieved date Apr. 27, 2020.*
English translate (EP0820823A1), retrieved date Mar. 8, 2021.*
International Search Report from Corresponding International Application No. PCT/EP2017/055970 dated May 22, 2017.
Written Opinion from Corresponding International Application No. PCT/EP2017/055970 dated May 22, 2017.

* cited by examiner

DEVICE FOR APPLYING AN APPLIED FORCE TO A CONNECTION ELEMENT

TECHNICAL FIELD

The invention relates to a device for acting on a connection element with an applied force such that the connection element is plastically deformed by the application of force. The invention also relates to a method for operating such a device and to the use of said device as an electric riveting machine, all according to the preambles of the independent claims.

PRIOR ART

For some time now, it has been common practice for components to be attached by means of connection elements, which, by means of a deformation, permit a positive engagement between the elements that are to be attached. Customarily, the connection element is brought into a fully comprehensive operative connection with the components that are to be connected. Before the plastic deformation, this operative connection is detachable. The plastic deformation of the connection element results in the production of a positively engaging connection of the components.

One conventional method that produces a connection with the aid of a force applied to a connection element is riveting. In riveting, connection elements composed of metals, alloys, or plastics are used, which do not return to their original shape after the plastic deformation. During riveting, the rivet is inserted into a bore that extends through the two elements that are to be joined. The rivet is then mechanically deformed so that on at least one of the two sides on which the rivet was protruding by means of an overhang, a plastic deformation has taken place. As a rule, this produces the characteristic "mushroom head" of rivets. In order to obtain a particularly stable rivet, it has turned out to be useful if instead of a flat, straight exertion of force, the riveting machine describes a curve that moves in a circular motion about the rivet head in such a way that it is molded from all sides. Such a radial riveting technique makes it possible to achieve a good upper structure of the rivet with gentle forces.

WO 2005/007319 A1 (Zemp, T.) describes such a method in which a component connection, which is penetrated by at least one component, is completed by a molding machine. Before the riveting, a projection is determined, which is used to establish the parameters of the force application, for example the molding path, molding time, and molding force.

Usually, such devices for applying force to connection elements are accommodated in machine tools. To accomplish this, the machines must be advantageously accommodated in a particularly space-saving way. In the prior art, numerous devices are known that use hydraulic or pneumatic drives to produce the necessary applied force. Modern hydraulic and/or pneumatic drives can be produced in a suitably compact design such that it is easily possible to install them in most machine tools. A well-known disadvantage of hydraulic machine drives, however, is the danger of a contamination of the tool chamber with hydraulic fluid. Particularly in the production of medical technology, in clean rooms, and/or in precision mechanics, such contamination is especially undesirable.

FR 2 660 219 (Roslyj, W. et al) describes one such riveting device, which is particularly compact. The device provides a fixed truck frame, which houses a hydraulically driven ram, which is also operatively connected to a rotary device. The impact axle ends at a punch for applying force to a deformable material. This device, however, is not suitable for installation in machine tools with an increased cleanliness requirement.

There is thus a need for devices of the type mentioned at the beginning, which are compact and permit use in a tool chamber with increased cleanliness requirements. In particular, a device of the type explained at the beginning should be provided, which has a low maintenance cost and can be easily integrated into a machine tool.

This object is attained with a device, a method, and the corresponding use according to the characterizing part of the independent claims.

DESCRIPTION OF THE INVENTION

One aspect of the present invention relates to a device for acting on a connection element with an applied force. This applied force should act on the connection element such that it is plastically deformed by the exertion of force. As defined by the present invention, this plastic deformation can be accompanied by other molding processes. For example, in parallel to it, a heating of the connection element can take place, which, in addition to the positive connection that is produced by the plastic deformation, produces a nonpositive connection between the elements to be joined. In a particular embodiment, the connection element is a connection element composed of a metal, a metal alloy, and/or a plastic, which, by means of a plastic deformation, is suitable for assuming a new shape that is not reversible without the application of a considerable force. Preferably, the connection element is designed so that this new shape makes it possible for the elements, which are to be joined to each other, to be mechanically locked relative to each other. This can, for example, be in the form of a rivet that penetrates two elements, which are to be joined, with an overhang that is plastically deformed.

The device according to the invention also comprises a movably mounted head part with a machining head. The machining head is adapted so that it is able to contact the connection element. For purposes of the present invention, the device can therefore be spoken of as having a distal end and a proximal end. The distal end is the one, which, during operation, is the closest to the connection element that is to be acted on. The proximal end of the device is the one that can be operatively connected to a machine tool. Particularly preferably, this operative connection is a transmission of electrical energy and signals. In this example, the machining head is a component of the distal end of the device. The machining head is preferably composed of a material, which is harder than the connection element that is to be acted on.

In a particular embodiment, the machining head is a punch. In an alternative embodiment, the machining head is a rolling element for rolling forming. In a particularly preferred embodiment, the rolling element has a plurality of rolling bodies selected from the group consisting of rollers, cones, balls, cylindrical rollers, needle rollers, conical rollers, and barrel rollers, for acting on a connection element that is to be machined; in particular, it comprises between two and nine rolling bodies. A machining head in the form of a rolling body can be used for achieving a chip-free shaping of a connection element. Optionally, the balls and/or rollers can be provided with surface structures that are transferred to the connection element that is to be molded, e.g. a profiling, fluting, and/or roughening.

In a particular embodiment, the device is designed in modular fashion so that the head part is replaceable. It is thus possible, for example, to replace a head part that has a machining head designed as a punch with a head part that has a head part designed as a roller bearing. It is naturally also possible to replace head parts with the same type of machining head. In this way, for example, the caliber of the machining head can be replaced or quite simply a head part of the same design can be replaced.

In a particular embodiment, the head part comprises a connection element for an operatively connected and reversible accommodation of a machining head, in particular a punch or rolling element such as a rolling head.

For purposes of the present invention, a head part can be viewed as movably mounted if the head part together with the machining head can be moved along at least one axis. In the present example, it is particularly preferable for the head part to be supported in linear fashion along the longitudinal axis of the device so that the movable head part can execute a translational movement along the longitudinal axis of the device.

The device according to the invention also comprises a first drive, which is adapted to drive a translation of the head part in the longitudinal axis of the head part. Preferably, the first drive is adapted to drive this translation in such a way that the applied force is applied to the connection element from the machining head. The first drive is preferably a linear drive. Particularly preferably, it is positioned so that it is in front of the head part. In other words, the first drive is preferably positioned proximally inside the device relative to the head part.

The device according to the invention also comprises a second drive, which is adapted to drive a rotation of the machining head, in particular of the punch, about the longitudinal axis. For purposes of the present invention, the longitudinal axis can be defined as the central axis of rotation of the device. It essentially corresponds to the axis of the application of force and extends longitudinally from the proximal end of the device to the distal end. Preferably, the second drive is designed so that the punch is able to describe at least one dosed curve In a particular embodiment in which the machining head has at least one rolling body, the drive is designed so that the at least one rolling body can be rotated about the central longitudinal axis of the device and in particular, is able to describe a closed curve.

In a particular embodiment in which the machining head has at least one rolling body, the machining head comprises a second transmission, which is adapted to reduce the rotation speed of the drive.

The device according to the invention also comprises a housing for accommodating the first drive, the second drive, and the head part.

In the device according to the invention, the first drive and second drive are electrically driven and coaxially arranged. For purposes of the present invention, a coaxial arrangement can in other words be defined, for example, as equipped with coinciding rotational axes.

In a particular embodiment, no hydraulic and/or pneumatic components are accommodated in the device according to the invention. In a particular embodiment, the housing is composed of a plurality of parts. A first housing part can be designed to accommodate the first drive, while a second housing part is designed to accommodate the head part together with the second drive.

In a particular embodiment, the second drive is positioned in the head part. In this embodiment, the second drive is supported in movable fashion. In a particular embodiment, the housing is composed of one piece.

In a particular embodiment, the housing is composed of a plurality of parts, in particular composed of two parts. One possible advantage of accommodating the drives in separate housing parts in the two-part housing embodiment is the modularity of the device according to the invention. A person skilled in the art can, as needed, modularly configure the arrangement that is suitable for him In terms of the rotation pattern that the second drive is supposed to enable or according to the stroke distances or applied force that can be supplied by the first drive.

The drives can also be designed to be replaceable independently of the housing parts.

For purposes of the present invention, an arrangement can be defined as coaxial if it have at least one coinciding axis of rotation. In the present example, the longitudinal axis of the device is the axis of rotation of the first drive and second drive.

By means of the device according to the invention, a device is provided for acting on a connection element with an applied force, which device has comparatively low space requirements and can be produced in a compact, slim form. This facilitates the integration of the device into a machine tool. The maintenance cost is also reduced since all of the drive-relevant elements are accommodated inside the housing and are thus protected from contamination or exposure.

In a particular embodiment, the housing is sealed off from the outside. This can be achieved, for example, by means of a sealing lip that prevents dirt and dust from penetrating between the two parts that move in relation to each other, i.e. between the head part and the inner wall of the housing. In a particular embodiment, the first drive is an electric linear drive.

It is particularly advantageous that forgoing the use of hydraulic fluid inside the device permits the device to be used in clean rooms.

In a particular embodiment, the first drive comprises a hollow shaft motor, particularly preferably a permanently excited hollow shaft motor. This cavity can accommodate a stroke of a threaded spindle and makes it possible to achieve a more compact design of the device according to the invention.

In a particular embodiment, the first drive also comprises a worm drive selected from the group consisting of: roller drives, ball drives, or planetary roller worm drives. Particularly preferably, the first drive comprises a planetary roller worm drive for executing an advancing movement of the head part. This makes it possible to supply particularly powerful forces with a simultaneously small embodiment.

In a particular embodiment, the first drive comprises a threaded spindle, which has a spindle pitch of 5 mm or less. This permits achievement of high dynamics with a simultaneously compact design. In a planetary roller worm drive, planets can roll with flutes that are arranged in parallel fashion. A spindle nut enables the rotation of the planets.

In a particular embodiment, the second drive comprises a permanently excited synchronous motor. In a particular embodiment, this is accommodated directly in the head part. Preferably, the second drive is positioned distally in relation to the first drive.

In particular, the second drive is adapted to produce an operative connection with the machining head, in particular the punch, and to set the latter into a rotational movement. The synchronous motor comprises a rotor and a stator. In a particular embodiment, the speed of the second drive can be controlled in an infinitely variable fashion.

In a particular embodiment, the housing comprises an orifice through which it is possible to move the head part at the distal end of the housing. In particular, the head part can be moved by a stroke. In a particular embodiment, this stroke essentially corresponds to the hollow shaft with regard to the dimensions of its longitudinal axis. The stroke can be bidirectionally controlled upward and downward in short time intervals. In a particular embodiment, the stroke is guided.

In a particular embodiment, the orifice has a sealing lip.

In a particular embodiment, the device comprises a force sensor which measures the applied force and is connected downstream of the first drive. In a particular embodiment, the force sensor is connected upstream of the second drive. By means of this arrangement, the force can be measured directly at is point of origin. As a result, the linear contact pressure of the first drive can be detected largely at its source. The force sensor can also be designed to detect a feedback, i.e. a resistance of the head part. In a particular embodiment, the force sensor is a piezoelectric force sensor. Alternatively, a strain cylinder, torsion cylinder, or spring can be used to measure the corresponding contact pressure.

In a particular embodiment, the housing comprises a guide for a translational movement of the head part. Preferably, the housing also has a rotation prevention with respect to the head part. The rotation prevention can be provided in the form of a one-piece component, which is formed onto the inner wall of the housing. Alternatively, the rotation prevention can be a separate rotation prevention that can be fitted into a corresponding guide rail of the inner wall of the housing. Particularly preferably, the rotation prevention is designed so that a translational movement of the head part within the housing is guided, but a rotation of the head part relative to the housing is prevented by the rotation prevention.

In a particular embodiment, the rotation prevention is embodied as a wedge inside the housing.

In a particular embodiment, the device comprises means for indirect force measurement with regard to the drives. In a particular example, this indirect force measurement can be ensured by means of the motor current.

In a particular embodiment, the device comprises guide rods, which extend from the head part to a first housing part and are supported in it by means of a guide slot. This slot prevents the head part from rotating relative to the first housing part.

In a particular embodiment, the housing comprises an integrated cable guide, which is adapted to convey electrical current and signals to the punch. In a particular embodiment, the device comprises an integrated cable guide, particularly designed as a spring coil in the housing. This spring coil can be adapted to compensate for the stroke of the head part without causing forces to be exerted on the cable guide.

In a particular embodiment, the device according to the invention comprises at least one tactile sensor for detecting a connection element. This tactile sensor can be used, for example, as is designed in WO 2005/007319 A1. In a particular and alternative embodiment, this tactile sensor can be enabled by means of the feedback of the force sensor. In an alternative embodiment, the tactile sensor comprises a capacitive sensor. It is likewise conceivable to use a force sensor for detecting a connection element. It is also possible to glean additional Information about the applied forces through the use of a strain gage or a piezoelectric sensor.

In a particular embodiment, the device comprises a connecting piece for connecting the device to a machine tool. This connecting piece can be designed with an additional seal in order to prevent dirt and dust from penetrating into the interior of the device.

With the device according to the invention, a device for acting on a connection element is provided, which can be used in a versatile way and permits a simple integration into existing machine tools with simultaneously lower maintenance costs and high operational dynamics. To a person skilled in the art, it goes without saying that all of the described embodiments can be implemented in an embodiment of a device according to the invention, provided that they are not mutually exclusive.

In a particular embodiment, the punch is designed as replaceable. The punch can comprise a defined punch profile, welches is adapted to the shape of the connection element that is to be produced. The punch profile can have a shape that is selected from the forms consisting of: flat, conical, shallowly cambered, flanged, folded-over, expanded, cylindrical, deeply cambered, and/or flanged inward.

In a particular embodiment, the first drive is designed so that it is able to execute a total stroke of between 0 and 500 mm and is able to execute a working stroke of between 0.01 and 100 mm.

In a particular embodiment, the device comprises at least one overload protection in order to limit an action of forces in a particular axis. Preferably, an overload protection is positioned between a housing part and the first drive so that an action of forces on the drive in the direction toward the housing part is limited. Preferably, an overload protection of this kind is designed as an elastically deformable element, in particular a spring, which exerts a restoring force in opposition to the force that is generated. In another particular embodiment, the device according to the invention comprises a plurality of overload protections; in particular, it comprises a first overload protection and a second overload protection, which are positioned between the first drive and at least one housing part so that an unexpected force acting on the drive or housing part is limited to a particular range by the overload protections.

In another particular embodiment, the device according to the invention comprises a manual rotation device for moving the drive when it is without power. Preferably, the manual rotation device is mounted so that it can be actuated from outside of the housing. This can be carried out in that the manual rotation device extends via a shaft from the outside of the housing into the housing interior and is operationally connected to the drive. It is therefore possible to move the drive, the spindle of the first drive, and the head part when without power. This can be particularly helpful for maintenance. In another preferred embodiment, the manual rotation device comprises a handle region at its proximal end, which permits an optimum transmission of force into the interior of the housing and onto the drive. Particularly preferably, the handle region of the manual rotation device is designed as ring-shaped so that the handle region can also be used as an anchor point for a load-lifting device, which facilitates transport of the device according to the invention. The simplicity of this handle region also makes it possible to forgo using a special tool for the manual operation of the device. The means and approaches for moving the device, especially the head part, can be executed from the outside by means of the manual rotation device on the drive, which further facilitates maintenance and upkeep of the device.

Another aspect of the present invention relates to the use of a device of the type described at the beginning, as an electric riveting machine for applying force and deforming connection elements. Particularly preferably, this use comprises a use of the device as a wobble/radial riveting machine. In this case, the rotary drive, i.e. the second drive, is designed so that it can execute a rosette-shaped movement.

The use according to the invention comprises the selection of the device size with regard to the desired forces. The size is also decisively determined by the diameter of the connection elements to be machined and by the rivet shafts. It lies within the capacities of a person skilled in the art to determine the suitable device dimensions in order to obtain a desired riveting result. The device shown can be used for connection element sizes in the range from 0.1 to 200 mm. It is particularly preferable to use the present device for riveting that has to meet increased precision requirements. The device according to the invention can be used for riveting forces of between 0.1 and 200 KN.

One advantage of the present invention is that the riveting force can be controlled in an infinitely variable fashion.

In a particular embodiment, the use includes the use as a rolling machine.

Another aspect of the present invention relates to a method for operating a described device, wherein a machine tool is used, which transmits control signals and electrical current to the device. A suitable machine tool can be a conventional workbench with corresponding electrical connections and control connections. The machine tools can also be part of a production line or production facility. Alternatively, they can also be part of a clean room or sterile room. The machine tool can also comprise other devices for additional preceding or subsequent work steps. In a particular embodiment, the machine tool is a fully automated machining center.

The method according to the invention first comprises the step of lowering the head part so that an operative connection with the connection element is produced. This operative connection can, but does not have to, result in a physical contact of the head part with the connection element via the punch. This lowering of the head part can include the overriding of a stroke, as explained above. In another step, the punch is driven to execute a circular movement. In another step, the punch is driven to execute a translational striking motion. This step can take place at the same time as the execution of the circular movement and/or in cyclical fashion relative to the latter.

In a particular embodiment, a connection element is detected by means of a tactile sensor and the parameters of the application of force are selected as a function of the detected connection element. Particularly preferably, the parameters are selected and adapted based on feedback.

Another aspect of the present invention relates to a machine tool including the device according to the invention. The machine tool can be part of a production line or can be a robot unit. So that the device according to the invention can be connected to the machine tool, an adapter can be provided in the form of a fastening unit that can be detachably connected to the device and permits it to be mounted to a console of the machine tool. The fastening unit can also be an integral component of the housing of the device, e.g. in the form of a corresponding structural formation on the housing, particularly on the first or second housing part, or can be formed in the process of connecting the two housing parts.

The invention will be explained in greater detail below based on the figures and on specific exemplary embodiments, without the scope of protection being limited to these. In the figures, analogous components have been provided with the same reference numerals unless explicitly noted otherwise.

BRIEF DESCRIPTION OF THE DRAWINGS

The drawings used to explain the invention schematically depict the following.

Figure 4:
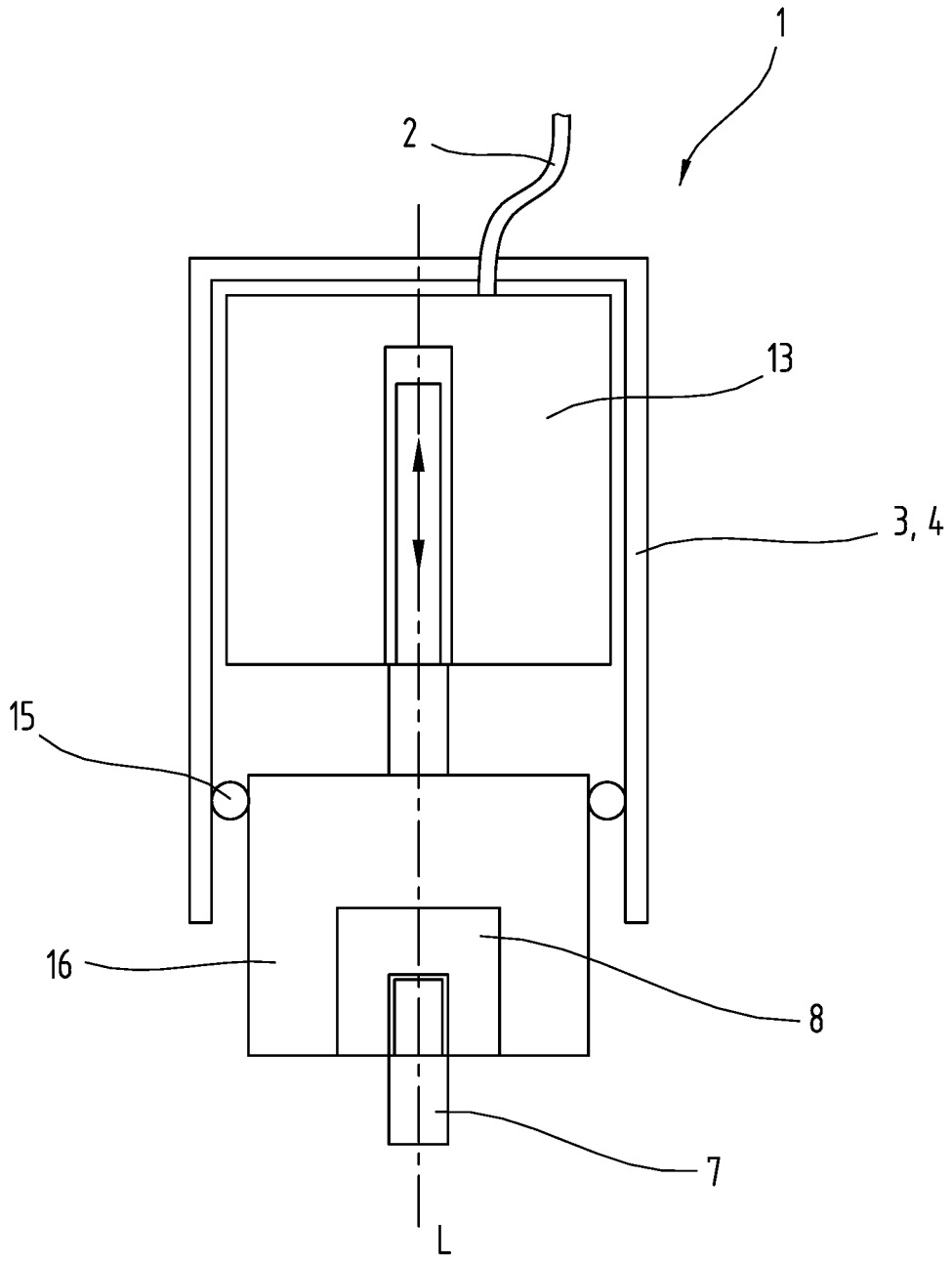
FIG. 4 shows a general schematic design of a concept according to the invention.

The simplest embodiment of the invention is illustrated in the simplest way in FIG. 4. The device 1 according to the invention shown in FIG. 4 has the form of a cylinder with a longitudinal span and a longitudinal axis L, which also essentially constitutes the central axis of rotation. The outer structure is formed by a housing 3, 4, which is designed as a sleeve. The housing 3, 4 is advantageously composed of aluminum. At its proximal end, the housing 3, 4 has at least one opening through which a connection 2 extends, which is used to transmit electrical signals of a machine tool to the interior of the device 1. Starting from this proximal end, on the interior of the housing 3, 4, a first linear drive 13 is positioned, which is rigidly mounted in the housing 3, 4. This linear drive 13 is designed to permit a movement along the longitudinal axis of a piston or spindle. This activates a head part 16, which, in a fully retracted state of the stroke of the linear drive 13, is almost completely enclosed by the sleeve of the housing 3, 4. A bearing 15 supports the head part 16 so that it is able to move in relation to the housing 3, 4 in a translational fashion relative to the longitudinal axis L. Preferably, however, the head part 16 is rotationally fixed, i.e. is fixed relative to a rotation about the longitudinal axis L. Inside the head part 16, a second drive 8 is provided, which is designed as a rotary drive. This second drive 8 activates a connecting pin 8.4, which is able to execute a circular movement about the longitudinal axis. This connecting pin 8.4 can be operatively connected to a machining head 7 for machining the connection element.

In this embodiment, both the first drive 13 and the second drive 8 are designed without pneumatic or hydraulic drives. In addition, the two drives 8, 13 are arranged coaxial to the longitudinal axis L of the device 1.

This simple arrangement achieves a device 1 for acting on a connection element by means of the punch, which device is compact and permits it to be used in a room with increased cleanliness requirements.

The machining head can be designed as a punch. The punch is then preferably composed of a material that is harder than the connection element that is to be machined, for example hardened tool steel. It has proven useful to use a punch made of steel. Depending on the field of application, this punch can also be provided with additional coatings that improve its abrasion resistance and wear resistance. Customarily, diamond compounds and ceramics are particularly suitable for such purposes.

Figure 1B:
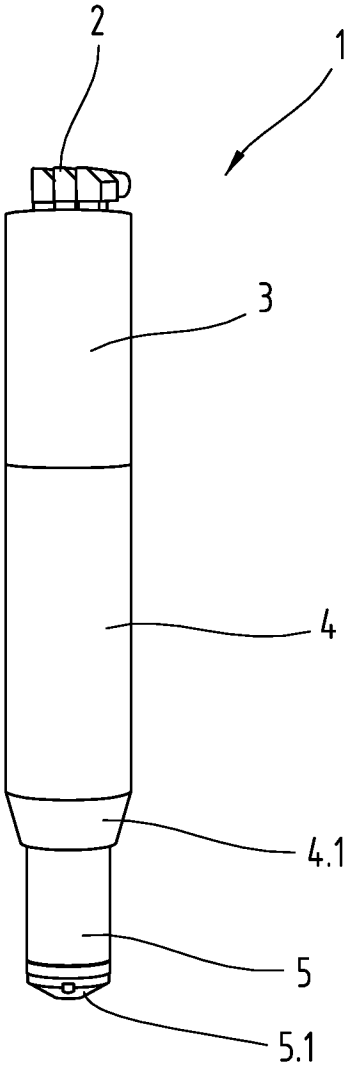
FIG. 1*b* shows the device from FIG. 1*a* in an extended stroke.
Figure 1A:
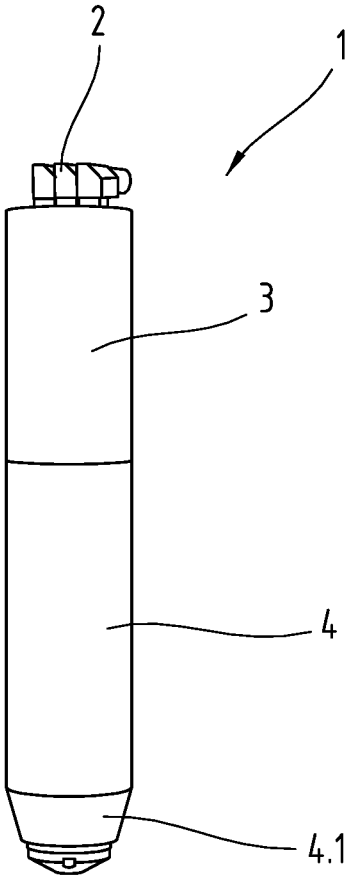
FIG. 1*a* shows an external view of a device according to the invention.

The compact design is also clearly shown in FIGS. 1*a* and 1*b*. These figures show a device 1 according to the invention in a retracted state (FIG. 1*a*) and in a state with a fully extended stroke (FIG. 1*b*). In this specific embodiment, the housing 3, 4 is composed of two parts. A first sleeve-shaped housing part 3 has the openings through which the connections 2 for the power and signal supply extend. This first housing part 3 is connected, for example by means of a bayonet connector, to a second housing part 4, which feeds into an orifice 4.1. In one embodiment, the second housing part 4 is screwed to the 3.

FIG. 1*b* with the fully extended stroke shows the head part housing 5 and the head part orifice 5.1. Inside this head part orifice 5.1, the machining head, e.g. a punch (not shown), is mounted, which acts on the connection element. During operation, this head part orifice 5.1 is placed over the connection element that is to be machined. In a particular embodiment, (not shown) this orifice can also be designed with sensor elements, which detects the dimensions of the connection element both when force is not being applied to it and when force is being applied to it. For example, this orifice can be designed with a capacitive sensor or Hall sensor. The device can, however, also simply be equipped with a force sensor.

Figure 2A:
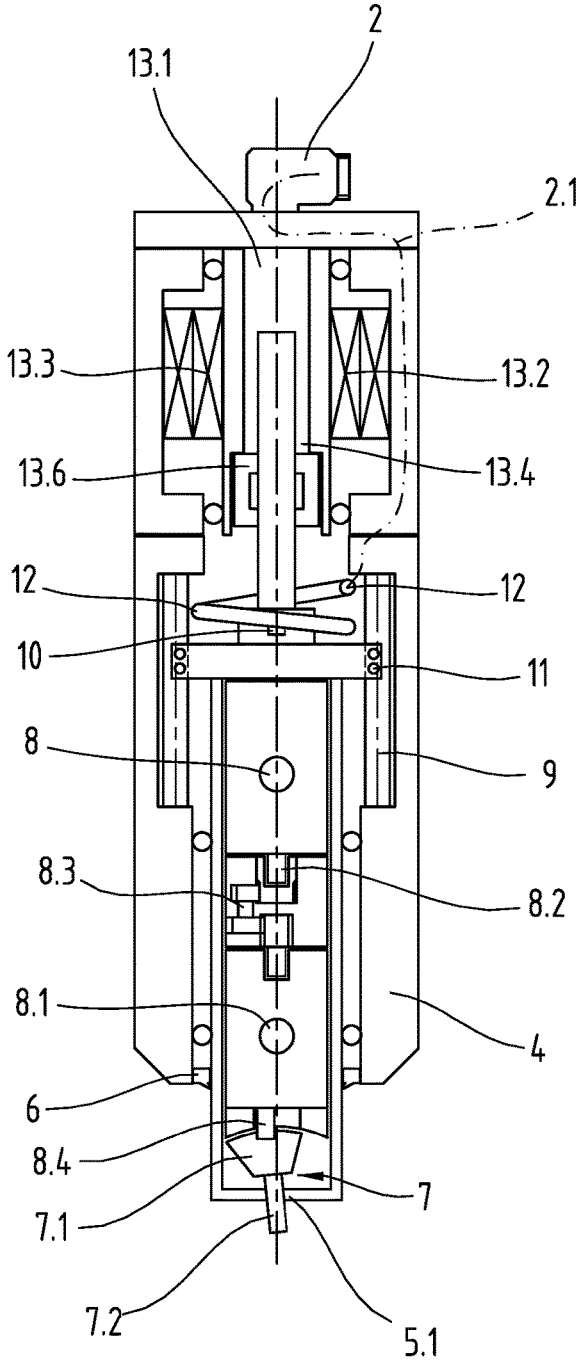
FIG. 2*a* shows a longitudinal cross-section through a device according to the invention.
Figure 2B:
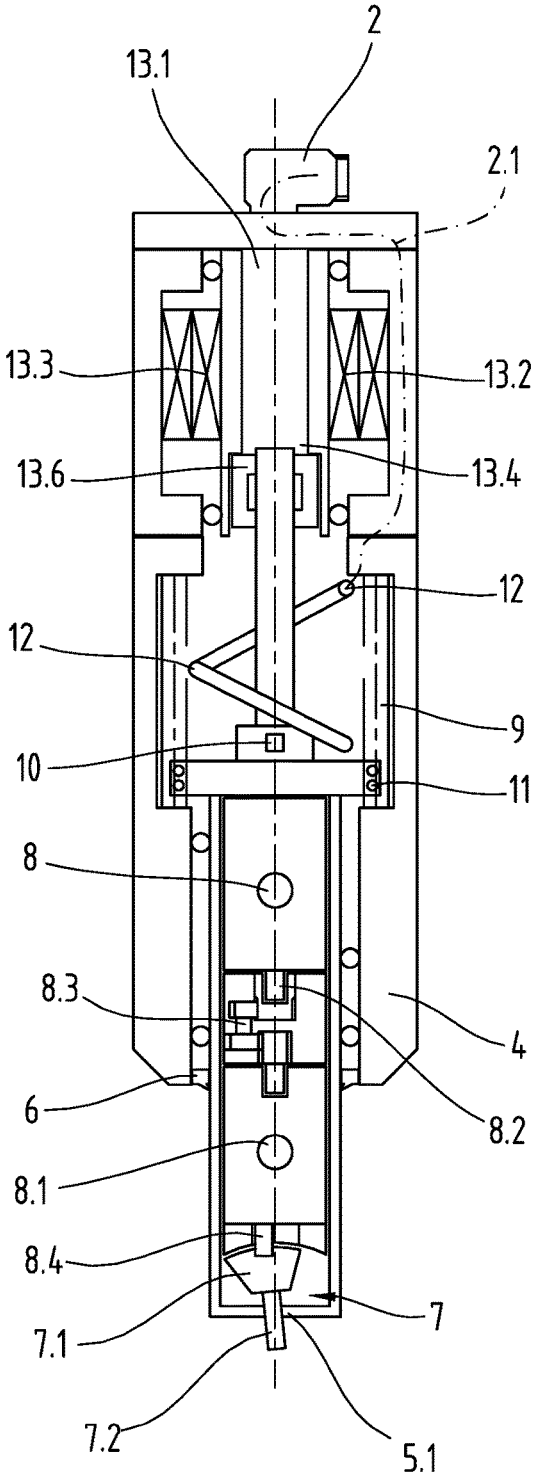
FIG. 2*b* shows the longitudinal cross-section from FIG. 2*a* in an extended stroke.

The interior of the devices 1 shown in FIGS. 1*a* and 1*b* is shown in FIGS. 2*a* and 2*b*, respectively in the retracted state (FIG. 2*a*) and the extended state (FIG. 2*b*). The two housing part 3, 4 are designed as sleeve-shaped and are connected to each other. At the distal end, the first housing part has an opening through which the connections 2 are routed, which open into a cable guide 2.1 on the interior for supplying electrical power to the drives and sensors of the devices 1. In the present example, the connection 2 is sheathed in order to better withstand the conditions in a machine tool. The connection 2 can also be adapted to required standards in order to be accommodated in a corresponding robot. In the present example, the first drive 13 is a hollow shaft drive. Inside the hollow shaft 13.1, a spindle 13.4 is provided, around which is placed an arrangement of a rotor 13.3 and stator 13.2, which enclose a hollow shaft 13.5. The spindle is guided by a threaded nut 13.6 and leads directly to a pressure sensor 10, which in turn is operatively connected to the head part housing 5. The rotary drive shaft 8.2 is operatively connected to the machining head 7 by means of a rotary mechanism 8.1. In the present example, the machining head 7 is designed as a riveting machine punch and essentially includes a punch 7.2 and a head part shaft 7.1. The punch is driven such that it is able to execute a circular movement about the longitudinal axis L by means of the rotary mechanism 8.1. In this depiction, this is insured by the connecting pin for the machining head 8.4, which is depicted in offset fashion relative to the longitudinal axis and is able to rotate about the latter. The rotary drive shaft 8.2 and the spindle of the first drive 13.4 are arranged coaxially along the longitudinal axis of the tool. A head part orifice 5.1 protects the machining head 7 and facilitates the guidance of the device to the connection element, which is to be machined. A sealing lip 6 is mounted between the head part 5 and the second housing half 4 that encompasses the head part. The routing of the electrical lines is accommodated entirely inside the housing 3, 4. In order to accommodate the corresponding translation of the head part, the cable guide is designed as a cable guide spring coil 12. In order to prevent a rotation by means of the second drive 8 inside the housing 3, 4 from being transmitted to the first drive 13, rods 9 are positioned in rod shafts, which are supported in a rotation preventer with a step bearing 11 in a rotationally fixed manner relative to the longitudinal axis of the device 1.

The machining head 7 does not have to be composed of two parts. In the present case, a head part shaft 7.1 is designed with a bushing to accommodate a connecting pin of the machining head 8.4.

In FIGS. 2*a* and 2*b*, a transmission gearing 8.3 is positioned between the rotary drive 8 and the rotary mechanism 8.1. This transmission gearing can be used to reduce the rotation speed of the rotary drive, e.g. if the machining head 7 is a rolling head (not shown). This transmission gearing is optional and is not necessary for the arrangement with a punch 7.2 as the machining head 7.

Figure 3:
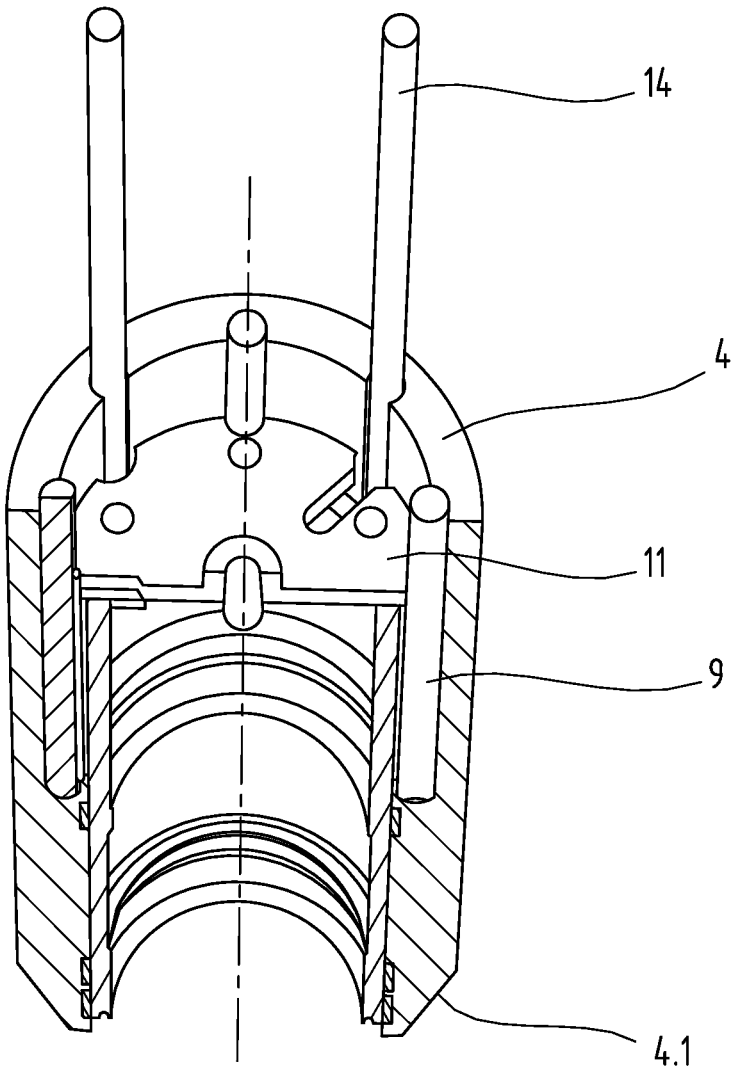
FIG. 3 shows the rotation prevention of the device according to the invention.

The embodiment of the rotation prevention will be explained once again in greater detail based on FIG. 3, which shows a schematic, perspective view of the second housing part 4 with the orifice 4.1 (bottom). The rods 9 extend over a significant part of the second housing part 4, which is equipped with an additional rotation preventer with a step bearing 11, which is accommodated in a rotationally fixed manner in the second housing part 4. The screws 14 of the head part extend across the entire connection site between the second housing part 4 and the first housing part (not shown in this depiction) and connect them in a rotationally fixed manner.

Figure 5:
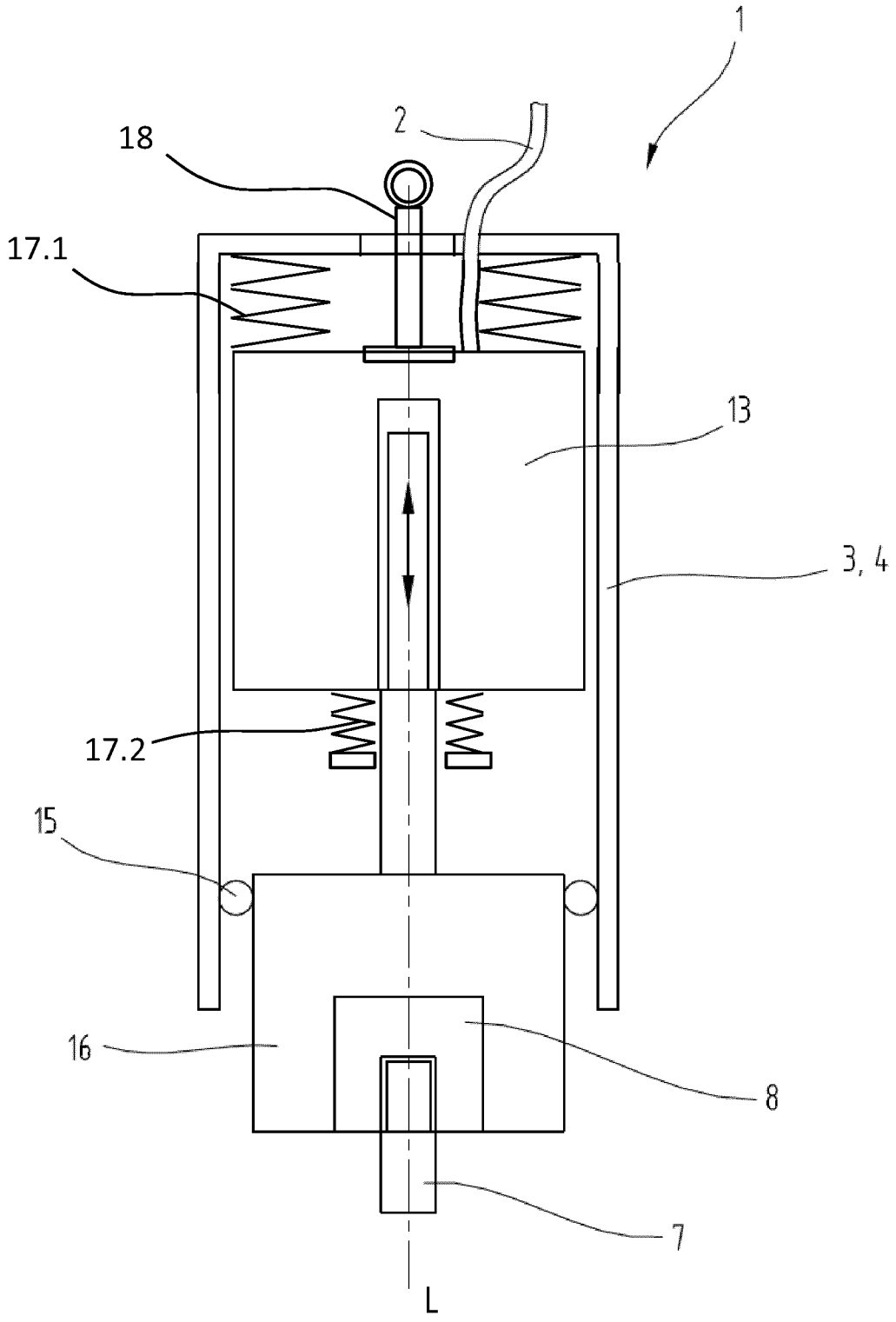
FIG. 5 shows a particular embodiment with overload protections.

FIG. 5 illustrates a device 1 according to the invention that is analogous to the one from FIG. 4, but which has additional advantageous embodiments. At its proximal end along the central axis of rotation L of the device 1, the aluminum housing 3.4 has an opening through which a manual rotation device 18 can be used to exert a manual rotation force directly on the shaft and the first linear drive 13. This device 1 also has overload protections 17.1, 17.2, which are positioned between the housing 3.4 and the first drive 13. A first overload protection is formed at the proximal end of the housing 3.4 in the form of a spring arrangement 17.1, which limit any forces that act on the first drive 13 with regard to its translational movement relative to the proximal end of the housing 3.4. A second overload protection in such a second spring arrangement 17.2 is likewise operatively connected—by means of tabs on the inside of the housing 3.4 (which can be an integral component of the housing 3.4)—to the drive 13 such that a translational force that acts on the drive 13 is likewise limited by this spring arrangement 17.2. The two overload protections 17.1, 17.2 protect the linear drive 13 from forces, thus increasing the ruggedness of the device. This embodiment, however, is entirely optional and is provided as a supplemental modification of the device according to the invention 1.

It goes without saying that the example shown is merely one embodiment of the attainment of the object according to the invention. If the individual embodiments are not mutually exclusive, then they can be united in any combination in a devices according to the invention without limiting the advantages of the present invention by doing so.

REFERENCE NUMERAL LIST

1 device
2 connection
2.1 cable guide
3 first housing part
4 second housing part
4.1 orifice
5 head part housing
5.1 head part orifice
6 sealing lip
7 machining head
7.1 head part shaft

7.2 punch
8 rotary drive
8.1 rotary mechanism
8.2 rotary drive shaft
8.3 transmission gearing
8.4 connecting pin for the machining head
9 rod
10 pressure sensor
11 rotation preventer with a step bearing
12 cable guide spring coil
13 first drive
13.1 hollow shaft
13.2 stator of the first drive
13.3 rotor of the first drive
13.4 spindle of the first drive
13.6 threaded nut
14 connecting screws
15 head part bearing
16 head part
17.1 downward overload protection
17.2 upward overload protection
18 manual lifting and turning device

The invention claimed is:

1. A device for acting on a connection element with an applied force, such that the connection element is plastically deformed by the application, comprising:

a. a movably mounted head part comprising a machining head designed as a punch or rolling element for rolling forming, wherein the machining head is adapted to contact the connection element;

b. a first drive adapted to drive a translation of the head part in the longitudinal axis of the head part, to drive it so that the applied force is applied to the connection element from the machining head;

c. a second drive adapted to drive a rotation of the machining head about the longitudinal axis, and to drive the machining head so that the punch is able to describe at least one closed curve;

d. a housing for accommodating the first drive, the second drive, and the head part; and wherein the first drive and the second drive each comprises an electrically driven motor and the electrically driven motors are coaxially arranged, and the second drive is arranged in the head part.

2. The device according to claim 1, wherein the motor of the first drive comprises a hollow shaft motor, and also comprises a screw drive selected from the group consisting of: roller drives, ball drives, or planetary screw drives.

3. The device according to claim 2, wherein the motor of the first drive comprises a threaded spindle having a spindle pitch of 5 mm or less.

4. The device according to claim 1, wherein the motor of the second drive comprises a permanently excited synchronous motor.

5. The device according to claim 1, wherein the device comprises a force sensor which measures the applied force and is connected downstream of the motor of the first drive, wherein the force sensor is connected upstream of the motor of the second drive.

6. The device according to claim 1, wherein the housing comprises a guide for a translational movement of the head part and wherein the housing comprises a rotation prevention with respect to the head part so that a translational movement of the head part within the housing is guided, but a rotation of the head part is prevented.

7. The device according to claim 6, wherein the rotation prevention and/or the guide are formed by at least one rod extending in the longitudinal direction through the housing and at least one step bearing for bearing the rotation prevention and/or the guide.

8. The device according to claim 1, comprising a cable guide integrated into the housing, and the cable guide is integrated into a spring coil in the housing, for conducting electrical signals between the head part and a connector.

9. The device according to claim 1, wherein the housing comprises a plurality of parts, wherein the housing comprises a first housing part and a second housing part, and wherein the housing parts are designed as detachably connectable to one another, so that a second housing part, which accommodates the second drive and the head part, is replaceable.

10. The device according to claim 1, further comprising at least one sensor for detecting a connection element.

11. A use of a device according to claim 1, as an electric riveting machine for applying force in a shape-changing way and deforming the connection elements to produce riveted connections, for applying force in a tumbling and/or radial fashion and deforming the connection element in order to produce riveted connections.

12. A method for operating the device according to claim 1, wherein a machine tool transmits control signals and electrical current to the device, comprising the steps:

a. lowering the head part into an operative connection with a connection element;

b. driving the machining head to execute a circular movement;

c. driving the machining head to execute a translational force-applying movement, as a working stroke.

13. The method according to claim 12, wherein a connection element is detected by means of a tactile sensor and as a function of the detected connection element, the parameters for the application of force are selected and adapted based on feedback.

14. A machine tool comprising the device according to claim 1 and a fastening unit that is detachably connectable to the device in order to affix the device in a machine tool.

* * * * *